US005153967A

United States Patent [19]

Zimmermann et al.

[11] Patent Number: 5,153,967

[45] Date of Patent: Oct. 13, 1992

[54] HANDLE FOR A PULL-ROPE STARTER

[75] Inventors: Helmut Zimmermann, Waiblingen; Michael Wissmann, Schorndorf, both of Fed. Rep. of Germany

[73] Assignee: Andreas Stihl, Waiblingen, Fed. Rep. of Germany

[21] Appl. No.: 744,911

[22] Filed: Aug. 14, 1991

[30] Foreign Application Priority Data

Aug. 14, 1990 [DE] Fed. Rep. of Germany ..... 4025667

[51] Int. Cl.[5] ..... B25G 1/00; B25G 3/10; F02N 1/00

[52] U.S. Cl. ..... 16/122; 403/372; 123/105.2; 123/185.3

[58] Field of Search ..... 16/122; 403/372; 123/185 A, 185 B, 185 BA, 185.2, 185.3

[56] References Cited

U.S. PATENT DOCUMENTS 1,171,170 2/1916 Casgrain ..... 123/185.3
3,212,487 10/1965 Johnson ..... 123/185.2
4,370,954 2/1983 Asao et al. ..... 123/185.3

*Primary Examiner*—John Sipos
*Assistant Examiner*—Carmine Cuda
*Attorney, Agent, or Firm*—Walter Ottesen

[57] ABSTRACT

The invention is directed to a handle for a pull-rope starter. The handle includes a T-shaped base body having an elongated part extending in the direction of the pull rope and a handle part extending transversely to the elongated part. The elongated part has a receptacle for accommodating an elastic expansion element which is connected at one end thereof to the pull rope. The expansion element is supported at its other end on the base body. The expansion element is as long as possible and has the longest possible expansion path. This is achieved in that the expansion element is supported at its upper end on the base body with the upper end facing away from the pull rope. In this way, the expansion element is stretched thereby providing a longer expansion path.

20 Claims, 5 Drawing Sheets

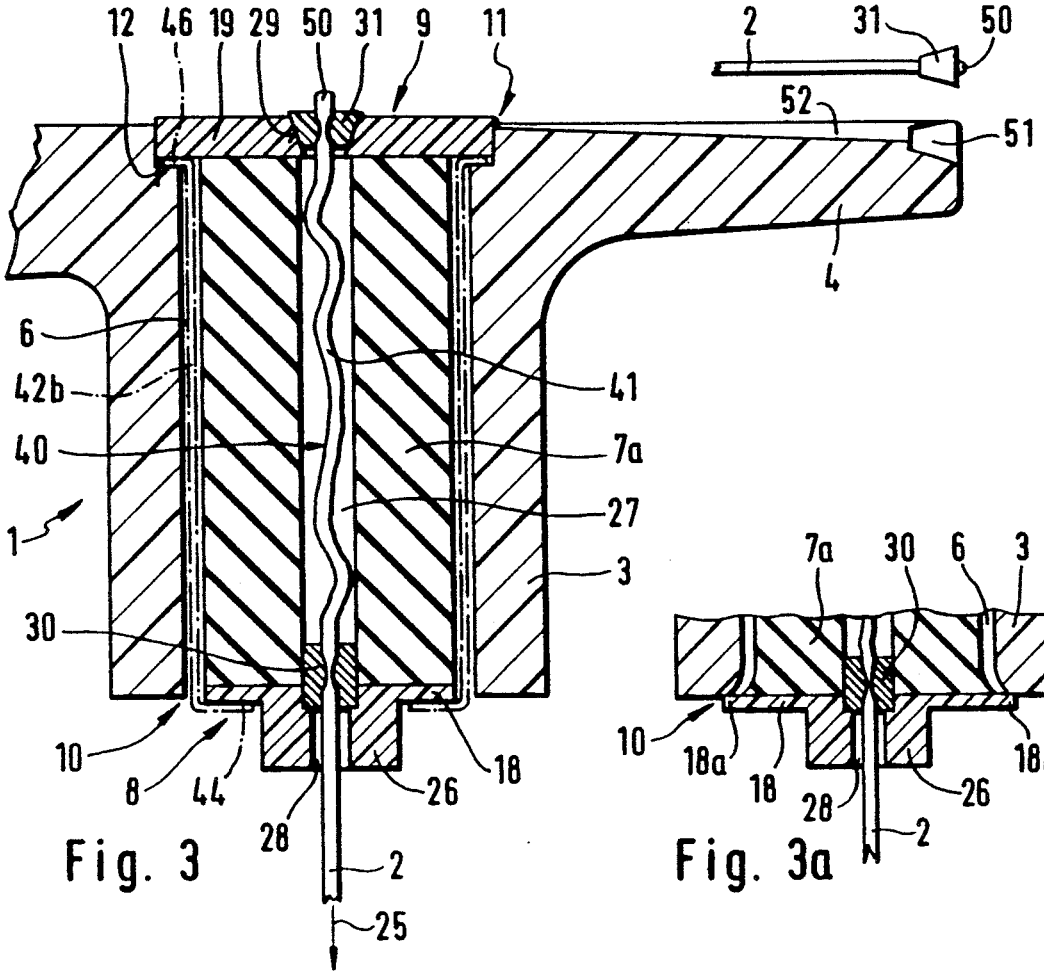
Fig. 3
Fig. 3a
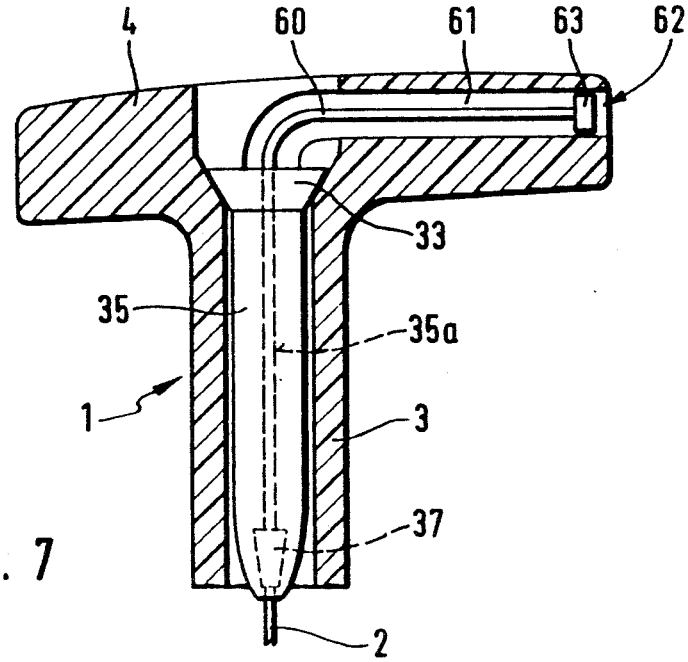
Fig. 7

HANDLE FOR A PULL-ROPE STARTER

FIELD OF THE INVENTION

The invention relates to a handle for a pull-rope starter having an approximately T-shaped base body. The base body has an elongated part extending in the direction of the pull rope and a handle part extending transversely to the elongated part. The T-shaped base body has a receptacle in the elongated part for accommodating an elastic expansion element which is connected to one end of the pull rope. The expansion element is supported at its other end on the base body.

BACKGROUND OF THE INVENTION

In a known handle of this kind, a cup-shaped recess is provided in the elongated part extending from the handle body for accommodating an elastic element. A pass-through opening for the pull rope is provided in the base of the recess. The pull rope passes through an elastic element disposed in the recess by means of a central pass-through opening. The end of the elastic element faces toward the handle body and the pull rope is connected with the elastic body at this end; whereas, the end of the elastic element facing toward the pull rope is supported at the base of the cup-shaped recess. The elastic element lies with play in the recess.

If a corresponding force acts in the direction of the pull rope, then a relative displacement is possible between the pull rope and the handle because of the compaction of the elastic element. Because of the compaction, the elastic element widens and then lies without play in the recess whereby the elasticity of the element reduces and its stiffness increases considerably.

A long element must be mounted in a correspondingly long recess in order to provide an adequate path in the direction of the pull rope. Since the possible expansion of the element is limited with its compaction by the inner diameter of the recess, this recess must be provided with tight tolerance. In addition, the requirement of long paths requires a handle which is configured so as to be relatively long.

SUMMARY OF THE INVENTION

It is an object of the invention to provide a handle having long expansion paths and a reduced handle length and yet provide a cost-effective mass production.

The handle of the invention is for a pull-rope starter and includes: an approximately T-shaped base body having an elongated part extending in the direction of the pull rope and a handle part extending transversely to the elongated part; the elongated part having a receptacle formed therein; an expansion element is connected between the handle and the pull rope for expanding in response to a pulling force applied to the handle; the expansion element being disposed in the receptacle and having a first end connected to the pull rope and a second end facing away from the pull rope; and, support means connected to the second end for supporting the expansion element on the base body.

The constructive arrangement of holding the expansion element in the handle according to the invention affords the advantage that the expansion element is lengthened when it becomes effective and can then emerge from the receptacle. The diameter of the expansion element is reduced when the same becomes longer so that imprecise dimensions in the receptacle have no effect on the expansion path. The required length of the handle is determined exclusively by the length of the expansion element in the unloaded condition.

According to a preferred embodiment of the invention, the lower end of the expansion element is connected to its upper supported end via a pull limiter having a length greater than the length of the expansion element in the unloaded condition. The pull limiter is preferably a rope and especially a segment of the pull rope. This pull-rope segment is effective only at the end of a permissible expansion path and connects the pull rope directly to the supported end of the expansion element, so that the pull rope is then connected directly to the handle. In this way, an overload of the expansion element because of a lengthening which is too great is prevented. It should be noted that the connection between the pull rope and the handle remains intact because of the pull limiter even when there is a break of the expansion element so that the pull-rope starter remains functional.

In a preferred embodiment, the pull limiter is provided with the aid of a fabric with which the pull-rope core and the connected expansion element are surrounded in a braid-like manner. In the region of the pull-rope core, the crossing angle is selected so as to be very steep so that the pull rope is hardly lengthened. In contrast, at the region of the expansion element, the crossing angle is selected so as to be slight so that an expansion is possible. The crossing angle however becomes steeper with a lengthening of the expansion element so that the expansion element becomes increasingly taut. At the end of the expansion path, the crossing angle is steep such that a rigid connection is provided between the pull rope and the handle.

BRIEF DESCRIPTION OF THE DRAWINGS

The invention will now be described with reference to the drawings wherein:

FIG. 3*a* is a section view of another embodiment of the handle of the invention;

FIG. 3*a* is a detail view of the foot plate of an expansion element according to another feature of the invention;

FIG. 7 is a section view taken through a further embodiment of the handle of the invention having an inner pull limiter for the expansion element;

DESCRIPTION OF THE PREFERRED EMBODIMENTS OF THE INVENTION

Figure 1B:
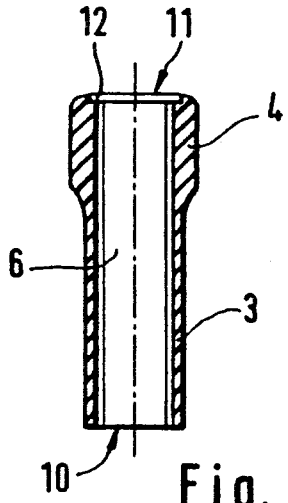
FIG. 1*b* is a section view taken along line A–B of FIG. 1*a;*

The handle shown in FIGS. 1 and 2 comprises essentially an ergonomically formed, T-shaped base body 1 having an elongated part 3 extending in the direction of a pull rope 2 (FIG. 3) and a handle part 4 extending transversely to the elongated part 3. The elongated part 3 lies off center to the handle part 4 such that, on one side of the elongated part 3, the handle part 4 has a length approximately twice that on the other side thereof. The longer segment of the handle part 4 and the center longitudinal axis of the elongated part 3 conjointly define an angle 5 which is somewhat greater than 90°. The handle part 4 otherwise extends in a straight line (FIG. 1*a*).

Figure 1A:
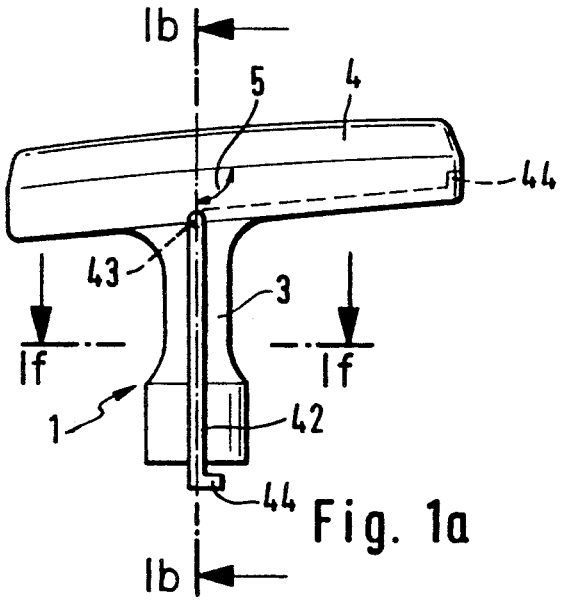
FIG. 1*a* is a side elevation view of an embodiment of the handle of the invention for a pull-rope starter.
Figure 1D:
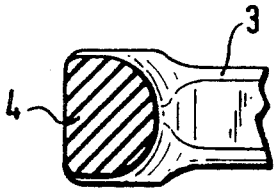
FIG. 1*d* is a section view taken along line E–F of FIG. 1*c;*
Figure 1C:
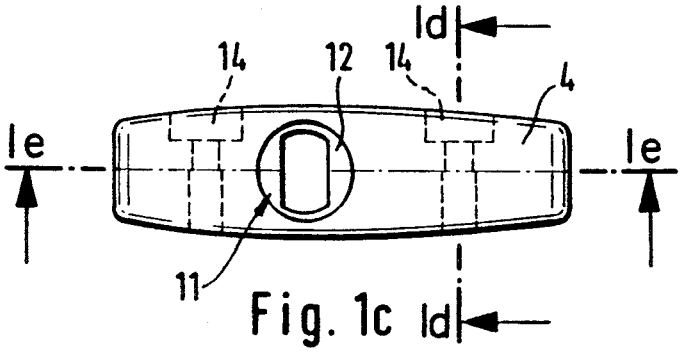
FIG. 1*c* is a plan view of the handle of FIG. 1*a;*
Figure 1E:
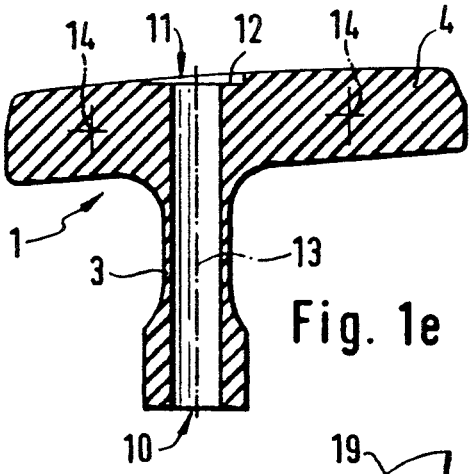
FIG. 1*e* is a section view taken along line C–D in FIG. 1*c;*
Figure 1F:
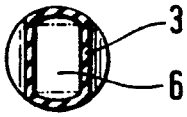
FIG. 1*f* is a section view taken along line G–H of FIG. 1*a.*

As shown in FIG. 1*b*, a receptacle 6 extends over the entire length of the elongated part 3 with the receptacle 6 extending through the handle part 4. As shown in FIG. 1*f*, the receptacle 6 has an approximately rectangularly-shaped cross section with the narrow sides of the cross section being slightly rounded. A precise rectangular cross section can also be advantageous as shown in phantom outline in FIG. 1*f*. A round cross section can be advantageous for a cost-effective manufacture of the receptacle and of an expansion element mounted therein.

The receptacle 6 extends through the handle part 4 and extends from the elongated part 3. The receptacle 6 has an end 10 facing toward the pull rope (not shown) at which the receptacle is open over its entire cross section (see FIGS. 1*b* and 1*e*). The receptacle is configured so as to be widened at its end 11 lying in the handle part thereby defining a peripheral shoulder 12. The shoulder 12 lies in a plane to which the center longitudinal axis 13 of the elongated part 3 is perpendicular.

The base body is preferably provided as a single-piece, injection-molded component made of plastic which is easily provided because the receptacle 6 is configured as a simple pass-through opening. However, it can also be advantageous to assemble the handle from two half shells which are tightly connected to each other via threaded fasteners 14 or rivets provided in the handle part 4.

Figure 1I:
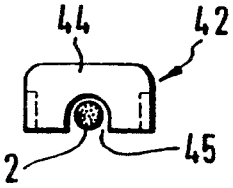
FIG. 1*i* is a plan view of the foot of a latching bracket.
Figure 1H:
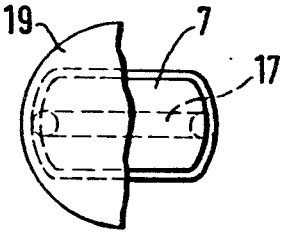
FIG. 1*h* is a plan view from below of the expansion element of FIG. 1*g;*
Figure 1G:
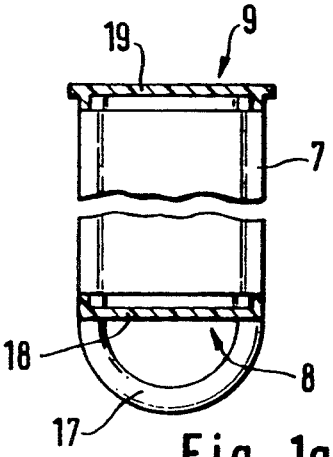
FIG. 1*g* is a side elevation view of an expansion element for the handle of FIG. 1*a;*

The expansion element 7 is provided as an insert in the receptacle 6 and is shown in FIGS. 1*g* and 1*h*. The expansion element 7 essentially comprises an elastic base body having axial ends 8 and 9 to which end plates in the form of a foot plate 18 and a head plate 19 are vulcanized, respectively. The end plates can be made of steel or the like but preferably are made of a plastic. In the embodiment shown in FIG. 1*g*, the foot plate 18 facing toward the pull rope has a bracket 17 formed thereon which is configured as a semicircle. The pull rope is attached to the bracket 17, for example, by tightly knotting the same thereto.

As shown in FIG. 1*h*, the upper head plate 19 facing toward the pull rope is configured so as to be circular and extends out over the expansion element 7 on all sides thereof with the expansion element 7 being configured so as to be approximately rectangular. The widening of the receptacle 6 in the handle part 4 provided at end 11 is configured to correspond to the circularly-shaped configuration of the upper head plate 19 (see FIG. 1*c*).

The expansion element 7 is seated through the end 11 in the receptacle 6 with the head plate 19 being supported at the shoulder 12 at the end 11. The head plate 19 is then approximately flush with the base body 1 in the handle part 4 so that no disturbing projections are present in the outer contour of the handle. Preferably, the head plate 19 is fixed by means of a snap connection (not shown) in the handle part 4.

The expansion element 7 has a length in the unloaded condition which corresponds approximately to the length of the receptacle 6 so that the foot plate 18 lies approximately in the plane of the end 10 of the receptacle 6 for the unloaded condition of the expansion element 7. The expansion element 7 is in this way completely held in the receptacle 6 and protected against dirt and the influences of weather.

If the pull-rope starter is actuated by an abrupt pull of the handle, the expansion element 7 acts to equalize the pull load. The lower end plate 18 then exits out of the receptacle and the cross section of the expansion element becomes less. The expansion element can be configured so as to be relatively long because of the support and arrangement of the expansion element provided by the invention so that a correspondingly long expansion path is presented.

In special start situations, the operator can desire that the expansion element 7 be rendered ineffective. For this purpose, a U-shaped bracket 42 is provided as a latch device as shown in FIG. 1*a*. The bracket 42 is fixedly mounted on the handle so as to be pivotable with its free leg ends about the rotation axis 43. The rotation axis 43 preferably lies on the longitudinal center line of the elongated part 3. In the inoperative position (broken line), the bracket 42 lies below the handle part 4 with the base plate 44 advantageously being recessed in the handle part. In its operative position (solid line), the base plate 44 of the bracket 42 lies below the foot plate 18 of the expansion element 7 so that the exit of the foot plate 18 from the receptacle 6 is prevented thereby also preventing an expansion of the element 7. The pull forces are diverted via the foot plate 18 directly onto the base plate 44 and transmitted directly to the handle via the legs of the bracket 42 and its attachment to the handle. The handle is connected rigidly to the pull rope in the operative condition of the bracket. The base plate 44 of the bracket 42 has a cutout 45 (FIG. 1*i*) through which the pull rope 2 passes (FIGS. 1*i*).

A further embodiment of the handle of the invention is shown in FIGS. 2*a* to 2*i*. Here, the handle corresponds essentially to the handle shown in FIGS. 1*a* to 1*i* except for the configuration of the receptacle and latch device. The same parts are here identified by the same reference numerals.

Figure 2B:
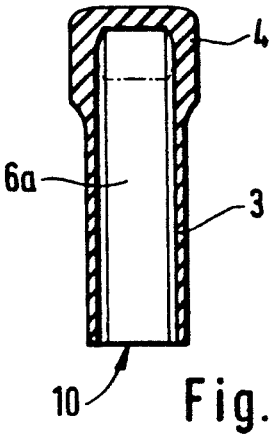
FIGS. 2*a* to 2*i* are a set of views of a further embodiment of the handle of the invention with the views corresponding to the views of FIGS. 1*a* to 1*i*, respectively.
Figure 2A:
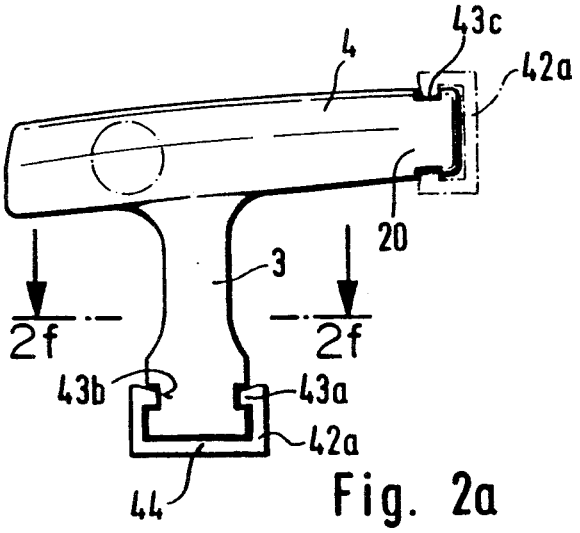
Figure 2D:
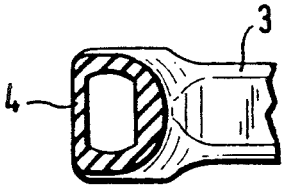
Figure 2C:
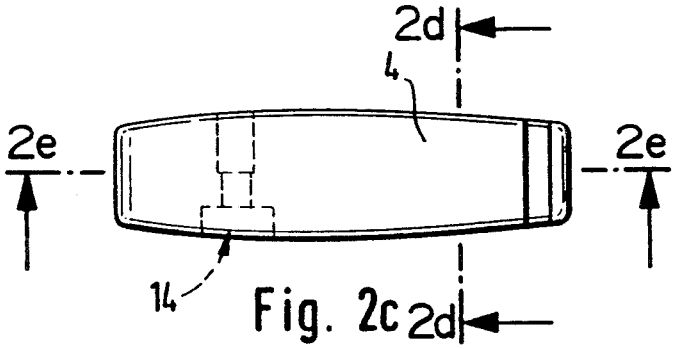
Figure 2E:
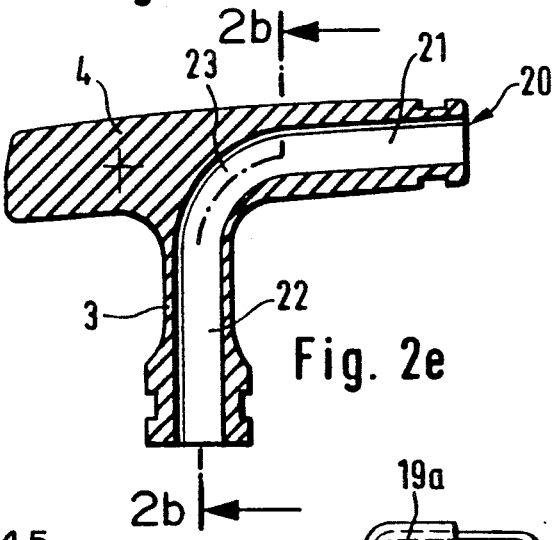
Figure 2F:
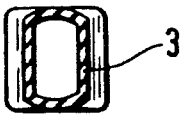
Figure 2I:
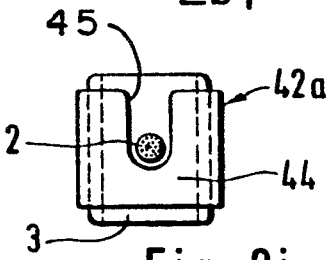

The receptacle 6*a* (FIG. 2*b*) extends from the lower end 10 of the elongated part 3 in a direction toward the handle part 4 and extends in a curve into the plane of the handle part. The receptacle extends to one end 20 of the handle part 4 with the segment 21 of the receptacle 6*a* lying at approximately right angles to the component segment 22 lying in the elongated part 3. The arc-shaped segment 23 then defines approximately a quarter circle (FIG. 2*e*).

Figure 2H:
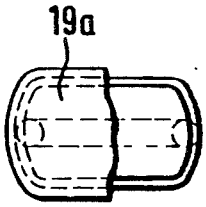
Figure 2G:
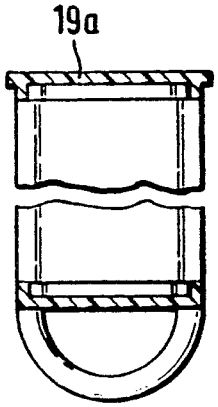

As a departure from the configuration of the expansion element of FIGS. 1*g* and 1*h*, the head plate 19*a* is configured to correspond in plan view to the cross section of the expansion element 7 in FIGS. 2*g* and 2*h*. The head plate 19*a* has an edge which extends outwardly beyond the expansion element on all sides thereof and is supported on the end 20 of the handle part 4. The head plate 19*a* has a size so that it does not extend beyond the outer contour of the handle part 4.

A bracket-like clamp 42*a* is provided as a latch device and has bent-over ends 43*a* which engage in a corresponding slot 43*b* of the elongated part 3. When the clamp 42*a* is pushed into place (solid line), the base plate 44 thereof lies below the foot plate 18 and thereby blocks the expansion path of the expansion element. The pull rope 2 (FIG. 2*i*) passes through a cutout 45 in the base plate 44. In the non-operating position of the clamp 42*a* (broken line shown in FIG. 2*a*), the clamp 42*a* is pushed into a corresponding slot 43*c* on the free end of the handle part 4 and is thereby held so that it cannot be lost. It can also be advantageous to attach a cup-like sleeve by means of a bayonet connection or the like at the free end of the elongated part 3.

A preferred embodiment of the handle of the invention is shown in FIG. 3. In this embodiment, the base body 1 is configured as a single piece and has a receptacle 6 which is configured to correspond to the embodiment of FIGS. 1*a* to 1*i*. At the end of receptacle 6 facing toward the pull rope 2, the receptacle 6 is open over its entire rectangular cross section and widens at its end 11 facing away from the pull rope 2 thereby defining a shoulder 12 in the handle part 4 which surrounds the end 11.

An expansion element 7*a* is held in the receptacle 6. The expansion element 7*a* has a head plate 18 and a foot plate 19 at its two ends 8 and 9, respectively, which serve as end plates. The end plates are preferably vulcanized to the main body of the expansion element 7*a* which comprises an elastic material such as rubber. The foot plate 18 has a dimension corresponding to the rectangularly-shaped cross section of the expansion element; whereas, the head plate 19 has an edge which extends beyond the base body of the expansion element 7*a* on all sides thereof. The expansion element 7*a* is disposed in the receptacle 6 with play on all sides with the foot plate 18 lying approximately in the plane of the lower end 10 of the receptacle 6. The upper end plate then lies on the shoulder 12 in the handle part 4 so as to be approximately flush therein. The length of the expansion element 7*a* corresponds then to the length of the receptacle 6. The foot plate 18 has dimensions adapted to the receptacle 6. The dimensions permit an entry of the foot plate into the end 10 of the receptacle 6.

As shown in FIG. 3*a*, it can however also be advantageous to configure the transverse or longitudinal dimensions of the foot plate 18 so as to be wider than the corresponding dimensions of the receptacle 6. The expansion element 7*a* is then pushed into the receptacle 6 at the end 11 with the foot plate 18 for which the foot plate 18 is positioned transversely. By stretching the expansion element 7*a*, the foot plate 18 extends out of the lower end 10 of the receptacle 6 and straightens itself again and then lies with its extending edges 18*a* against the end face of the elongated part 3. In this way, the expansion element 7*a* is held on the elongated part 3 of the handle between its end plates 18 and 19 so that it cannot become lost.

The expansion element 7*a* has a central pass-through opening 27 having respective ends which extend into pass-through openings 28 and 29 provided in the plates. The pass-through opening 28 in the end plate 18 has a diameter which is less than the central pass-through opening 27 in the expansion element 7*a*. The pull rope 2 is introduced through the pass-through opening 28 into the central pass-through opening 27 and provided with a clamped ring 30 having an outer diameter approximately corresponding to the outer diameter of the central pass-through opening 27. The plastic ring 30 is injection molded onto the pull rope and is supported on the foot plate 18 in an adapted recess since the pass-through opening 28 is configured so as to be less in diameter. Preferably, the ring 30 lies tightly clamped in the recess of the foot plate 18 and for this purpose, the outer diameter of the ring is configured so as to be correspondingly adapted.

The expansion element 7*a* is lengthened by stretching with forces applied in the direction of the pull rope with the expansion element 7*a* being supported with its head plate 19 in the base body 1. In this way, a relatively long expansion element 7*a* can be used. For this reason, a long expansion path is provided and therefore excellent damping is obtained.

The lower end of the expansion element 7*a* is connected in pull direction 25 with its upper supported end via a pull limiter 40 in order to limit the stretching of the elastic base body of the expansion element 7*a*. The length of the pull limiter 40 is greater than the length of the expansion element 7*a* in its unloaded condition. Preferably, a pull-rope segment 41 is provided as a pull limiter 40. For this reason, the pull rope is lead outwardly through the ring 30 through the central pass-through opening 27 and out through the pass-through opening 29 in the head plate 19. The end of the pull-rope segment 41 is anchored in the head plate 19, for example, by utilizing an adhesive, clipping or some other form-tight holding means. A second ring 31 can be injection molded on the end of the pull rope projecting out of the upper end plate 19. The second ring 31 is larger with respect to its outer diameter than the pass-through opening 29.

As shown in the embodiment of FIG. 3, the second ring 31 is configured so as to be conical and lies with its tip facing toward the head plate. The pass-through opening 29 is conically expanded in the direction toward the ring 31 so that the ring 31 can be substantially accommodated in the head plate 19 and thereby lie flush in the handle. The pull-rope segment 41 lies slack in the pass-through opening 27 and has a stretched length which is longer than the length of the expansion element 7*a* in the unloaded condition. When the expansion element 7*a* is stretched, then the pull-rope segment 41 becomes taut until, at the end of the expansion path, the pull rope 2 is connected directly to the head plate 19 and therefore directly to the handle. In this way, the expansion element is prevented from becoming destroyed by an overstretching thereof.

In FIG. 3, the end plate 18 has an annular part 26 which is configured as a single piece with the end plate 18 and projects beyond the plane of the end 10 of the receptacle 6. The annular part 26 accommodates and guides the handle on the pull-rope starter.

Two embodiments of latch devices are shown in FIG. 3 with which the handle 1 is connected rigidly to the pull rope 2 in the operating condition. One embodiment is defined by an insert 42*b* which is seated in the receptacle 6 and lies with an upper annular flange 46 on the shoulder 12 of the base body 1 so as to be supported thereon. The length of the insert 42*b* is so dimensioned that it can accommodate the expansion element 7*a* in its full length such that the head plate 19 lies on the annular flange 46 and therefore is also supported on the shoulder 12. The foot plate 18 then lies on the base plate 44 of the insert 42*b* with the annular part 26 projecting outwardly through a central opening in the base plate 44. If the pull rope 2 is loaded in pull direction 25, then the pull force is applied via the ring 30 and the foot plate 18 to the base plate 44 of the insert 42*b* and is transmitted further via the annular flange 46 to the shoulder 12 in the base body 1. The handle is rigidly connected to the pull rope.

The insert 42*b* can be configured so as to be adapted to the form of the receptacle 6 or the form of the base body 7*a*. It is however adequate that a U-shaped bracket is provided as insert 42*b* as shown in FIG. 1*a*.

Another embodiment of a latch device comprises that the end of the pull rope 2 is connected directly to the handle. For this purpose, and according to FIG. 3, the end 50 with the injection-molded ring 31 is pulled out of the expansion element 7*a* and is hooked into a corresponding recess 51 in the handle part 4. The conical ring 31 is held in the correspondingly configured seat 51 in pull direction 25 whereby a rigid connection to the base body 1 of the handle is provided. The pull rope 2 then lies in a slit 52 which extends from the end 11 of the receptacle 6 to the recess 51. The pull rope 2 must be pulled out from the expansion element so far because of the length of the handle part 4 such that the force transmitting connection between the ring 30 and the foot plate 18 is cancelled. In this way, the pull force is directed via the ring 31 and the recess 51 into the handle part 4.

Figure 4:
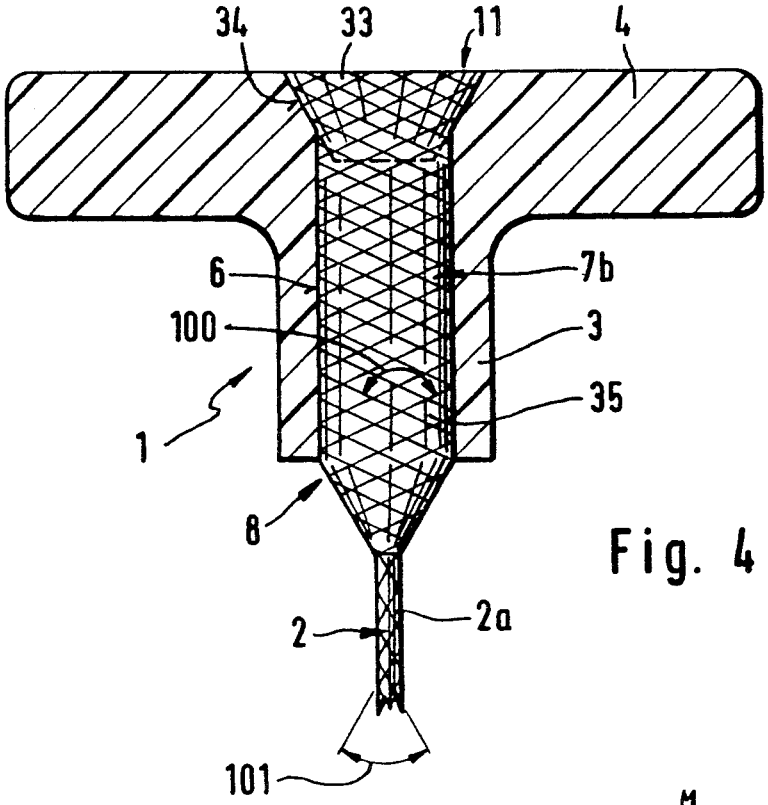
FIG. 4 is a section view of another embodiment of the handle of the invention.
Figure 5:
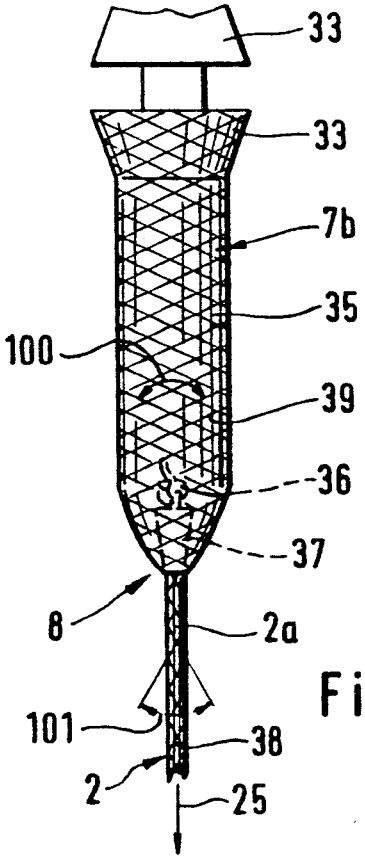
FIG. 5 is a schematic of an expansion element for the handle of FIG. 4.

FIG. 4 shows the base body 1 of a further embodiment of the handle of the invention wherein an expansion element 7*b* is seated in the receptacle 6. The expansion element comprises a conical head part 33 which is held in the conical seat 34 configured in the end 11 of the receptacle 6. The elastomeric body 35 of the expansion element 7*b* is injection molded onto the head part 33 preferably made of plastic. In this injection-molding process, the other end 8 of the expansion element 7*b* is simultaneously injection molded onto the core 2*a* of the pull rope 2. For this purpose, and as shown in FIG. 5, the end 36 of the rope core 2*a* is threaded through a rope holder 37 and knotted. The rope holder 37 together with the knot 36 are embedded in the elastomer of the elastomeric body 35.

The rope core 2*a* and the elastomeric body 35 are surrounded by a braided textile fabric or the like with the braiding 38 having a very steep braiding angle 101 in the region of the rope core 2*a*; whereas, in the region of the elastomeric body 35, the braiding 39 is provided with a very flat braiding angle 100. The steep braiding angle 101 of the braiding 38 makes the pull rope in the pull direction very rigid so that a lengthening of the rope core 2*a* is substantially prevented. Because of the low braiding angle 100 of the braiding 39 of the elastomeric body 35, the latter becomes longer in the pull direction 25 whereby the braiding angle of the braiding 39 becomes steeper. The braiding angle of the braiding 39 is so selected that the braiding 39 permits an expansion in the start position of the expansion element 7*b*; however, a steep braiding angle is reached upon reaching the maximum expansion so that a further stretching of the expansion element 7*b* becomes impossible. The braiding 39 thereby acts as a stretch limiter for the expansion element 7*b* and ensures a rigid connection between the pull rope 2 and the head part 33 of the expansion element upon reaching the maximum expansion.

By shaping the elastomeric body 35 in an appropriate manner, the spring response of the expansion member 7*b* is adjustable. Accordingly, a progressive spring response can be obtained by configuring the elastomeric body 35 as a conical body.

In FIG. 5, the head part 33 is shown as a double head part which is advantageous for the manufacture of pull ropes provided with expansion elements, especially, for the manufacturing process of the braiding since an unending chain can be formed in this manner.

Figure 6:
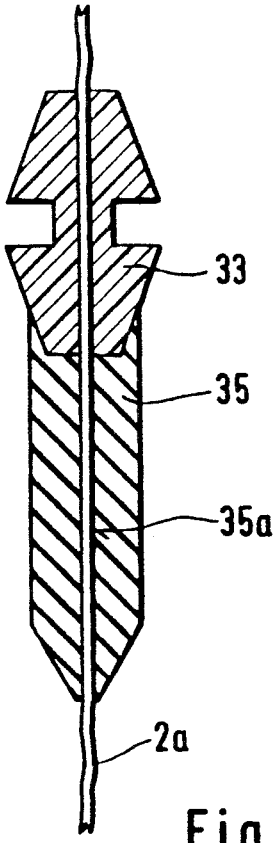
FIG. 6 is a schematic of still another expansion element for the handle of FIG. 4.

Elastomeric bodies 35 having a central pass-through bore 35*a* are injection molded on the head part 33 pursuant to a further embodiment of the expansion element shown in FIG. 6. These base bodies for an expansion element are then threaded onto the core 2*a* of a pull rope and the threaded row is surrounded with braiding as for the expansion element of FIG. 5. The rope core 2*a* is again surrounded by braiding at a steep braiding angle; whereas, in the region of the elastomeric body 35, a flat braiding angle is provided.

After braiding is completed, the row is undone so that an elastomeric body 35 surrounded by braiding with the pull rope 2 braided thereto is formed. The expansion element of FIG. 6 is then seated in the base body 1 of a handle pursuant to FIG. 5 (see FIG. 4).

Another embodiment of a pull limiter is shown in FIG. 7. An elastomeric body 35 (not surrounded by braiding) is injection molded to a head part 33. The pull rope 2 is attached to the elastomeric body 35 at the end lying opposite the head part 33 via an injected rope holder 37. The elastomeric body 35 has a central pass-through bore 35*a* in which a steel wire 60 is placed so as to be approximately free of play. The steel wire is connected at one end to the rope holder 37 and extends through the head 33 into a longitudinal bore 61 in the handle part 4. The free end 62 of the steel wire has a head 63 which is greater than the pass-through bore in the head part 33 of the expansion element. When the elastomeric body 35 expands, the steel wire is pulled along through the head part 33 of the expansion element until the head 63 of the steel wire comes against the head part 33 of the expansion element and a rigid connection between the pull rope 2 and the base body 1 of the handle is established. The central pass-through bore 35*a* becomes smaller because of the expansion of the elastomeric body 35. For this reason, the elastomeric body 35 applies an increased friction torque with increasing length to the steel wire 60 so that a progressive spring response is obtained.

Figure 8:
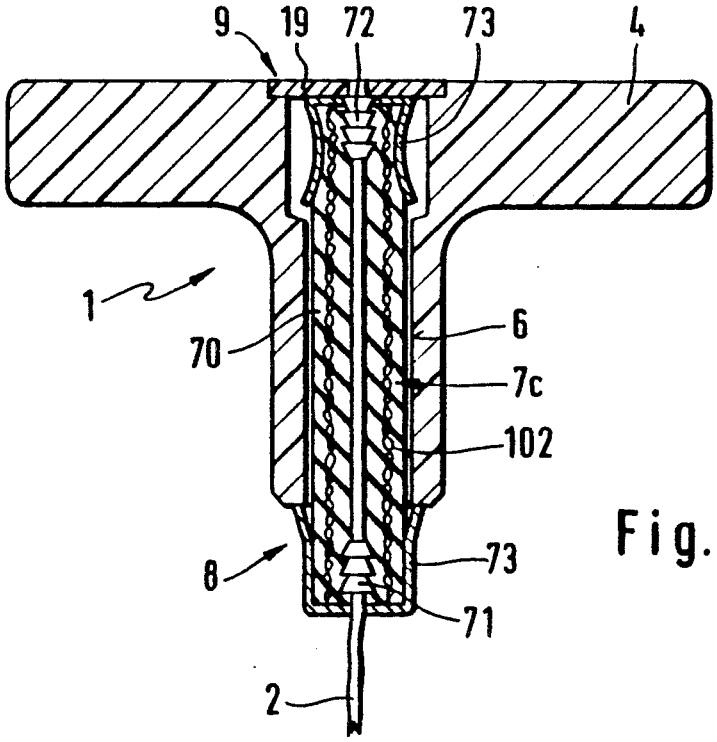
FIG. 8 is a section view taken through a handle according to another embodiment of the invention wherein the expansion element is made of a hose segment.
Figure 9:
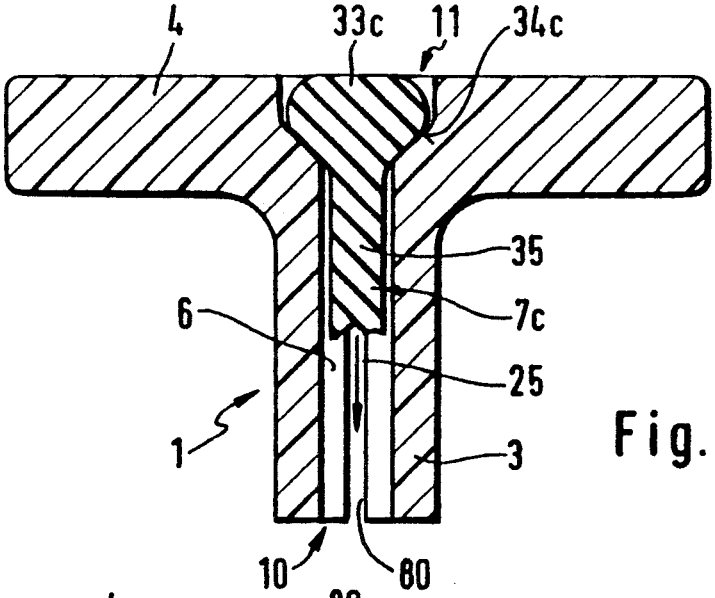
FIG. 9 is a section view of another embodiment of the handle of the invention wherein the pull rope has separated because of overload; and, FIG. 10 is a plan view of the handle of FIG. 9.
Figure 10:
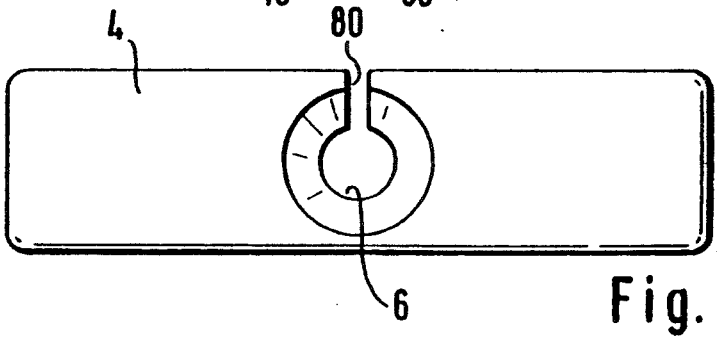

In a further embodiment of the invention shown in FIG. 8, a built-up expansion element 7*c* is provided by utilizing a hose segment. The hose segment 70 has a cross-laid fabric 102 in its wall. This fabric 102 defines the pull limiter 40 when the hose segment is increased in length thereby resulting in a steeper braid angle. Pull anchors (71, 72) are pressed into respective ends (8, 9) of the hose segment 70 in order to attach press sleeves 73. The pull anchor 71 is connected to the pull rope 2;

whereas, the pull anchor 72 is connected to an upper end plate 19 (head plate). The expansion member 7c configured in this manner is seated in the receptacle 6 of a base body 1.

A conventional tension band can be used in lieu of the hose segment. Since the core of such a tension band comprises a bundle of individual threads, the pull anchors can be introduced without difficulty and the crimp sleeves can be fixed to the ends of the tension band. The outer fabric braid defines the pull limiter for the damping member also for an embodiment of this kind.

In lieu of a fabric braid surrounding the elastomeric body, a telescope-like casing can be provided which provides a rigid connection between the handle and the pull rope when the maximum expansion path is reached.

The significant advantage of expansion elements with stretch limitation is that even when there is a destruction of the expansion element (damping element), a connection between the handle and the pull rope remains via the stretch limiter so that the pull-rope starter remains operational.

In a further embodiment of the invention, the expansion element 7c is configured with an elastic head part 33c. The head part 33c is configured as a thickened end of the elastomeric body 35 and is preferably one piece with the latter. The head part 33c lies in a correspondingly expanded receiver pan 34c at the end 11 of the receptacle 6. If the elastomeric body 35 is loaded in the pull direction 25, it becomes longer in the manner described and effects a damping of the occurring impacts or the like. The thickened head 33c is pulled through the end 11 into the receptacle 6 with increasing length until the thickened end slips through the receptacle 6 and exits at the end 10 when the maximal permissible force or lengthening of the expansion element 7c is reached. Pull rope and handle are separated from each other with the occurrence of an overload.

For a renewed start attempt, the pull rope is placed laterally into the receptacle 6 for which a corresponding elongated slit 80 is provided over the entire length of the receptacle in the elongated part 3. The expansion element 7c is again introduced via the end 11 into the receptacle until the thickened head 33c lies in the receiving pan 34c. The connection between the handle and the pull rope for the next starting operation is reestablished.

It is understood that the foregoing description is that of the preferred embodiments of the invention and that various changes and modifications may be made thereto without departing from the spirit and scope of the invention as defined in the appended claims.

What is claimed is:

1. A handle for a pull-rope starter, the handle comprising:

an approximately T-shaped base body having an elongated part extending in the direction of the pull rope and a handle part extending transversely to said elongated part;

said elongated part having a receptacle formed therein;

an expansion element connected between said handle and said pull rope for expanding in response to a pulling force applied to said handle;

said expansion element being disposed in said receptacle and having a first end connected to said pull rope and a second end facing away from said pull rope;

support means connected to said second end for supporting said expansion element on said base body; and, limiting means interconnecting said first and second ends of said expansion element for limiting the length to which said expansion element can be stretched when subjected to said pulling force.

2. The handle of claim 1, said latching means including holding means attached to one end of said limiting means; and, recess means formed in said base body for receiving said holding means.

3. The handle of claim 1, said expansion element having a central pass-through opening formed therein for accommodating said limiting means.

4. The handle of claim 3, said limiting means including a segment of said pull rope connected between said ends.

5. The handle of claim 3, said limiting means including a steel wire having a diameter corresponding to the diameter of said pass-through opening.

6. The handle of claim 1, said limiting means including a fabric having a flat crossing angle.

7. The handle of claim 6, said expansion element being an elastomeric body; and, said fabric being disposed so as to surround said elastomeric body.

8. The handle of claim 6, said fabric being embedded in said elastomeric body.

9. The handle of claim 1, said receptacle being a clear-through channel formed in said base body so as to extend through said elongated part and said handle part.

10. The handle of claim 1, said expansion element lying in said receptacle so as to have play on all sides of said expansion element.

11. A handle for a pull-rope starter, the handle comprising:

an approximately T-shaped base body having a elongated part extending in the direction of the pull rope and a handle part extending transversely to said elongated part;

said elongated part having a receptacle formed therein;

an expansion element connected between said handle and said pull rope for expanding in response to a pulling force applied to said handle;

said expansion element being disposed in said receptacle and having a first end connected to said pull rope and a second end facing away from said pull rope;

support means connected to said second end for supporting said expansion element on said base body; and, said expansion element being a segment of a rubber tube.

12. A handle for a pull-rope starter, the handle comprising:

an approximately T-shaped base body having an elongated part extending in the direction of the pull rope and a handle part extending transversely to said elongated part;

said elongated part having a receptacle formed therein;

an expansion element connected between said handle and said pull rope for expanding in response to a pulling force applied to said handle;

said expansion element being disposed in said receptacle and having a first end connected to said pull rope and a second end facing away from said pull rope;

support means connected to said second end for supporting said expansion element on said base body;

said base body having an outer surface;

said support means including a head portion vulcanized to said expansion element at said second end thereof;

seat means formed in said base body for supporting said head portion in said base body so as to be flush with said outer surface; and, said expansion element including a rope holder vulcanized to said first end thereof.

13. The handle of claim 12, said receptacle being an opening in said elongated part having a cross section of given transverse and longitudinal dimensions; and, said rope holder having transverse and longitudinal dimensions greater than said transverse and longitudinal dimensions of said opening; and, said receptacle being elongated and having a predetermined length; and, said expansion element having a length corresponding to said predetermined length of said receptacle.

14. A handle for a pull-rope starter, the handle comprising:

an approximately T-shaped base body having an elongated part extending in the direction of the pull rope and a handle part extending transversely to said elongated part;

said elongated part having a receptacle formed therein;

an expansion element connected between said handle and said pull rope for expanding in response to a pulling force applied to said handle;

said expansion element being disposed in said receptacle and having a first end connected to said pull rope and a second end facing away from said pull rope;

support means connected to said second end for supporting said expansion element on said base body;

said handle part having an arm extending laterally away from said elongated part;

said receptacle being a clear-through channel formed in said base body so as to extend through said elongated part and said arm; and said channel being arcuate as it extends from said elongated part into said arm.

15. A handle for a pull-rope starter, the handle comprising:

an approximately T-shaped base body having an elongated part extending in the direction of the pull rope and a handle part extending transversely to said elongated part;

said elongated part having a receptacle formed therein;

an expansion element connected between said handle and said pull rope for expanding in response to a pulling force applied to said handle;

said expansion element being disposed in said receptacle and having a first end connected to said pull rope and a second end facing away from said pull rope;

support means connected to said second end for supporting said expansion element on said base body;

said expansion element being made of elastic material and said support means being a head part formed of said material to define said second end thereof;

said receptacle being a channel extending clear through said base body and having upper and lower ends;

seat means formed in said base body at said upper end of said channel for supporting said head part;

said head part being configured so as to become elongated and slide out of said seat means and through said channel in response to a predetermined overload pull force applied to said handle; and, slot means formed in said base body so as to extend into said channel to facilitate placing said expansion element in said handle.

16. A handle for a pull-rope starter, the handle comprising:

an approximately T-shaped base body having an elongated part extending in the direction of the pull rope and a handle part extending transversely to said elongated part;

said elongated part having a receptacle formed therein;

an expansion element connected between said handle and said pull rope for expanding in response to a pulling force applied to said handle;

said expansion element being disposed in said receptacle and having a first end connected to said pull rope and a second end facing away from said pull rope;

support means connected to said second end for supporting said expansion element on said base body; and, latching means for preventing said expansion element from protruding from said handle in response to a pull force applied to said handle.

17. The handle of claim 16, said expansion element having a foot plate at said first end thereof and said latching means being a base plate for fixing said foot plate.

18. The handle of claim 17, said latching means including an insert mounted in said receptacle and said base plate being part of said insert.

19. The handle of claim 16, said latching means including a bracket pivotally mounted on said base body for pivoting between a first position wherein said expansion element is released and a second position wherein said expansion element is prevented from protruding from said base body; and, a base plate mounted on said bracket for holding said expansion element when said bracket is in said second position.

20. The handle of claim 16, said latching means including a clamp removably mounted on said handle part; and, said clamp being adapted so as to be removably attached to said elongated part for preventing said expansion element from protruding from said handle.

* * * * *

UNITED STATES PATENT AND TRADEMARK OFFICE

CERTIFICATE OF CORRECTION

PATENT NO. : 5,153,967

DATED : October 13, 1992

INVENTOR(S) : Helmut Zimmermann and Michael Wissmann

It is certified that error appears in the above-indentified patent and that said Letters Patent is hereby corrected as shown below:

In column 11, line 42: after "and" (second occurrence), insert -- , --.

Signed and Sealed this

Fourth Day of January, 1994

Bruce Lehman

*Attest:*

BRUCE LEHMAN

*Attesting Officer*

*Commissioner of Patents and Trademarks*